US006584650B1

(12) United States Patent
Pettigrew et al.

(10) Patent No.: US 6,584,650 B1
(45) **Date of Patent: *Jul. 1, 2003**

(54) FIBER TUMBLER SYSTEM AND METHOD

(76) Inventors: Victoria I. Pettigrew, 18640 Castle Lake Dr., Morgan Hill, CA (US) 95037; Stephen H. Pettigrew, 18640 Castle Lake Dr., Morgan Hill, CA (US) 95037

( * ) Notice: Subject to any disclaimer, the term of this patent is extended or adjusted under 35 U.S.C. 154(b) by 40 days.

This patent is subject to a terminal disclaimer.

(21) Appl. No.: 10/082,966

(22) Filed: Feb. 25, 2002

Related U.S. Application Data

(63) Continuation of application No. 09/902,241, filed on Jul. 9, 2001.

(51) Int. Cl.[7] ..... D01B 3/04
(52) U.S. Cl. ..... 19/65 R; 19/66 R; 19/200
(58) Field of Search ..... 19/65 R, 66 CC, 19/66 R, 200, 204, 205; 15/330, 405; 8/156; 134/32, 33, 58 R; 34/58, 59, 318, 322, 328; 209/44.3, 288, 293, 295, 919, 925; 241/68; 273/246

(56) References Cited

U.S. PATENT DOCUMENTS

| | | | | | |
|---|---|---|---|---|---|
| 179,229 | A | * | 6/1876 | Smith et al. | 209/288 |
| 436,351 | A | * | 9/1890 | Gove | 209/286 |
| 2,491,877 | A | * | 12/1949 | Schug | 209/250 |
| 3,113,733 | A | * | 12/1963 | Carlson | 209/17 |
| 3,957,631 | A | * | 5/1976 | Santo | 209/288 |
| 4,268,294 | A | * | 5/1981 | Laughlin et al. | 65/506 |
| 4,288,077 | A | * | 9/1981 | Rose et al. | 273/138.1 |
| D265,094 | S | * | 6/1982 | Williams | D15/147 |
| 4,682,613 | A | * | 7/1987 | DeLoach | 134/109 |

* cited by examiner

*Primary Examiner*—Gary L Welch

(57) ABSTRACT

A system and method are provided for cleaning fiber. Included is a structure with a basket pivotally coupled thereto. The basket is adapted for receiving fiber therein. In use, particles are removed from the fiber upon rotation of the basket. In another embodiment, a system and method are provided for cleaning fiber utilizing just a basket for receiving fiber therein, and a blower for blowing the fiber in the basket to remove particles therefrom.

19 Claims, 5 Drawing Sheets

FIG 1
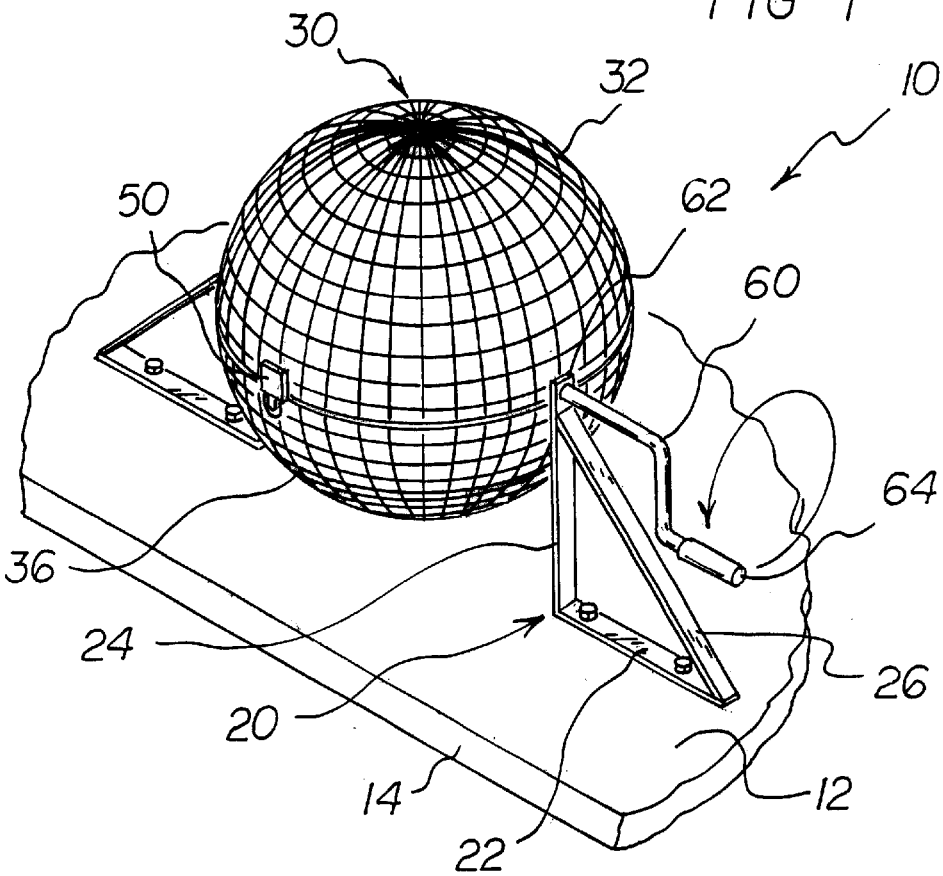
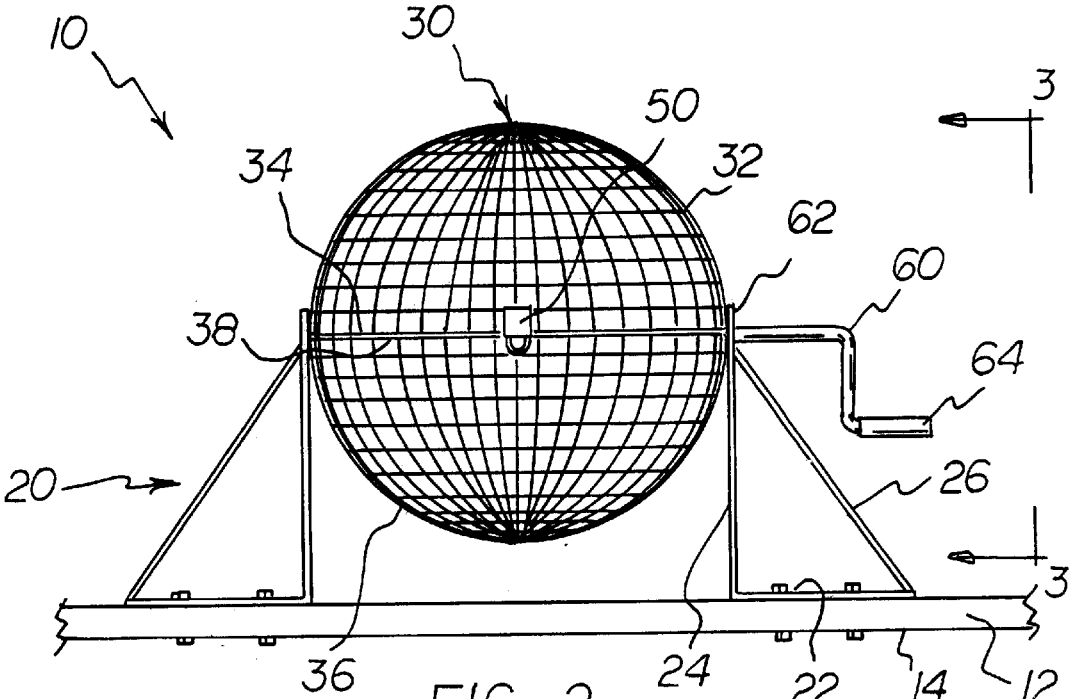
FIG 2

FIG 5
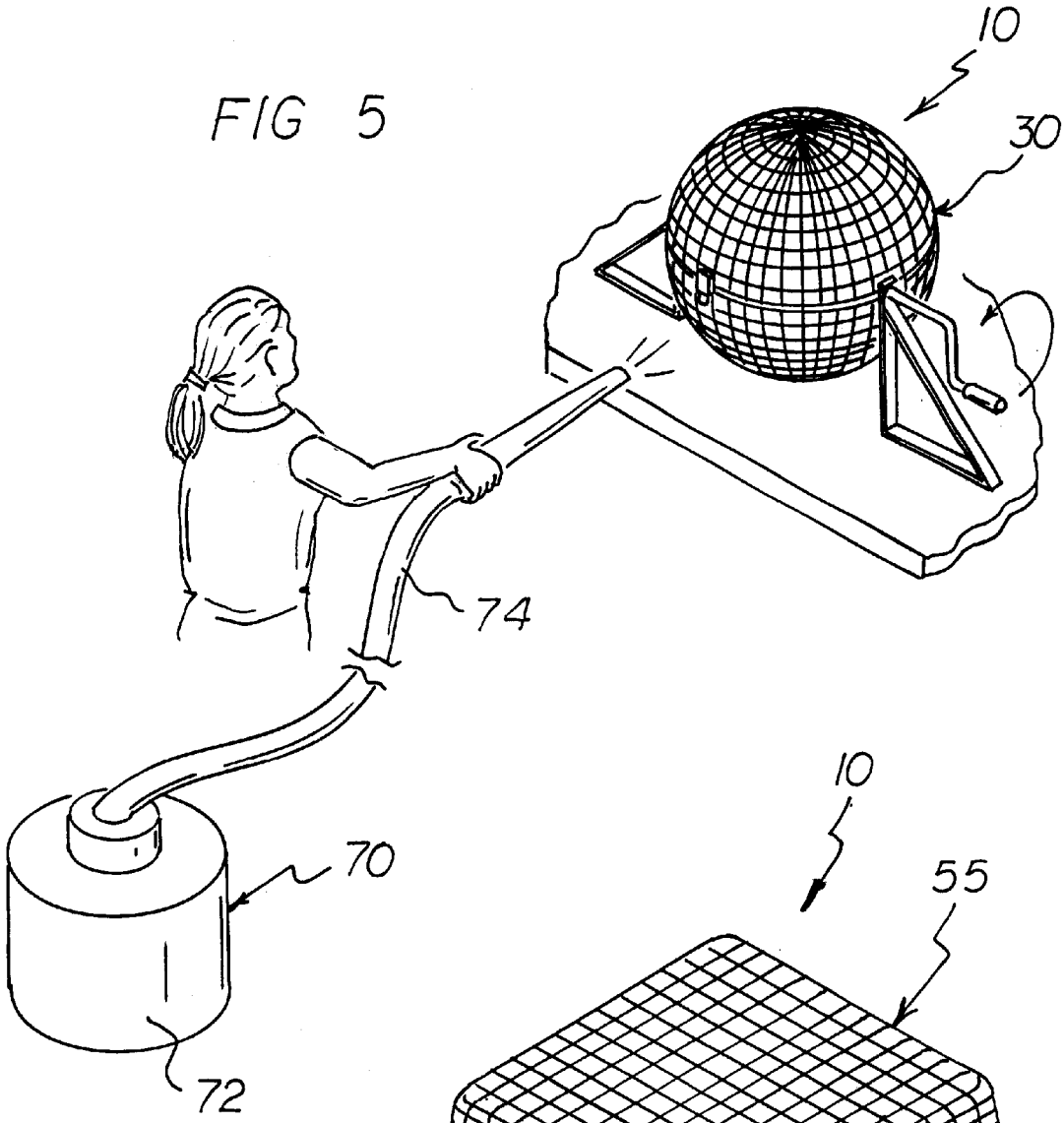
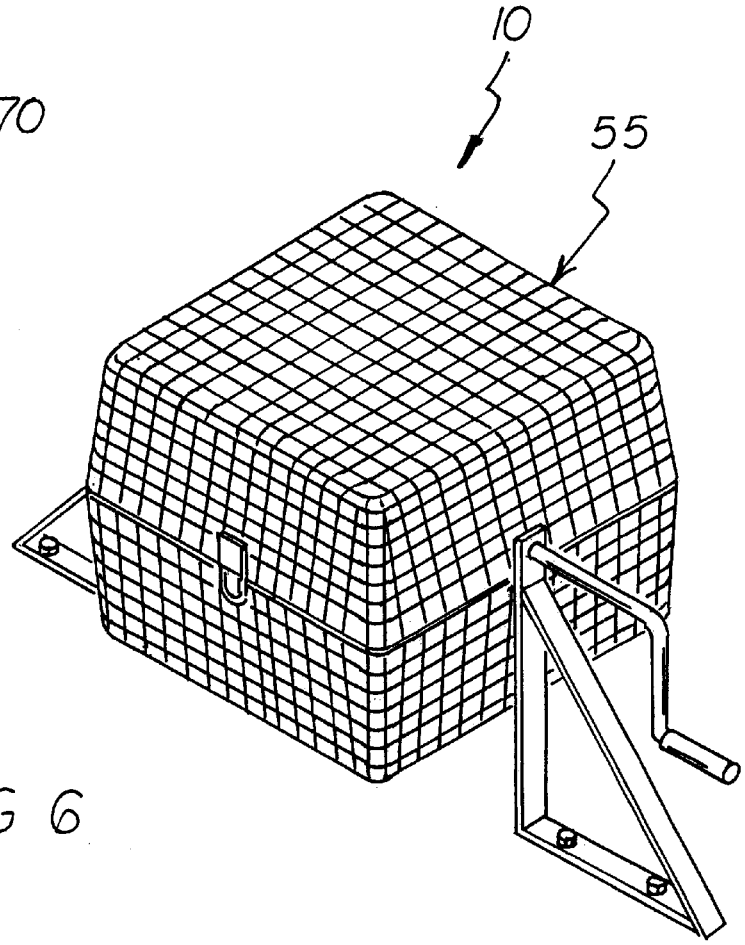
FIG 6

FIBER TUMBLER SYSTEM AND METHOD

RELATED APPLICATION(S)

The present application is a continuation of a parent application filed Jul. 9, 2001 under Ser. No. 09/902,241, which is incorporated herein by reference.

FIELD OF THE INVENTION

The present invention relates to cleaning fiber, and more particularly to cleaning fiber in preparation for spinning.

BACKGROUND OF THE INVENTION

In conventional spinning practice, single fibers are spun and used as basic building blocks in the manufacture of the more complex fiber structures. In use, the fiber is creeled in a spinning frame where it is subjected first to a draft, or attenuation, by which the linear density of the fiber is reduced to a required level, and is then twisted with an amount of twist which depends upon the weight of the fiber and its intended use. The spinning operation is normally carried out on a machine such as a ringframe, a cap-frame or a flyer-frame, in which the rotation of a spindle serves to both insert twist into the fiber and to wind the fiber onto a package carried on the spindle.

In the manufacture of plied fibers (i.e. a two-fold fiber), single fibers are creeled onto a twisting machine such as a ring-twister, where two or more single fibers are creeled for each spindle of the twisting machine. The single fibers are delivered together at a constant speed and are twisted together and wound onto a package by the rotation of the spindle.

Once the fiber has been spun, it can be wound into skeins for storage and transportation purposes. At this point, the fiber is ready for being further processed and/or used to create clothing articles and other consumer goods.

When carrying out the foregoing spinning process, it is important that the fiber be clean. Any particles entangled in the fiber in the initial stages of spinning will inevitably result in defects in the end product. As such, fiber is commonly cleaned before spinning. Often, this is accomplished by manually removing the particles by physically picking them from the fiber. This can often be tedious and laborious. Moreover, many particles that are deeply entangled in the fiber or too small to be noticed may be overlooked, resulting in defects in the end product.

There is thus a need for an improved method and apparatus for facilitating the fiber cleaning process.

DISCLOSURE OF THE INVENTION

A system and method are provided for cleaning fiber. Included is a structure with a basket pivotally coupled thereto. The basket is adapted for receiving fiber therein. In use, particles are removed from the fiber upon rotation of the basket.

In one embodiment, the basket may include an opening for receiving the fiber therein. The basket may have a substantially spherical configuration or a rectangular configuration. Still yet, the basket may include a pair of halves being positionable in an open orientation for inserting and removing fiber therefrom and a closed orientation for securing fiber therein. Further, the basket may be equipped with a fastener for securing the halves in the closed orientation.

As an option, a crank may be coupled to the basket to facilitate the rotation thereof. A blower may also be provided to facilitate the removal of the particles. The basket may include a wire mesh, where the wire mesh defines openings each with an area less than 1 square inch.

In another embodiment, a system and method are provided for cleaning fiber utilizing just a basket for receiving fiber therein, and a blower for blowing the fiber in the basket to remove particles therefrom.

These and other advantages of the present invention will become apparent upon reading the following detailed description and studying the various figures of the drawings.

BRIEF DESCRIPTION OF THE DRAWINGS

The foregoing and other aspects and advantages are better understood from the following detailed description of a preferred embodiment of the invention with reference to the drawings, in which:

FIG. 1 is a perspective view of a fiber tumbler for cleaning fiber prior to spinning, in accordance with one embodiment.

FIG. 2 illustrates a front view of the fiber tumbler in a closed orientation.

FIG. 5 shows a perspective view of the present invention in use.

FIG. 6 is a perspective view of an alternate embodiment of the fiber tumbler, where the basket has a substantially rectangular configuration.

DESCRIPTION OF THE PREFERRED EMBODIMENTS

Figure 3:
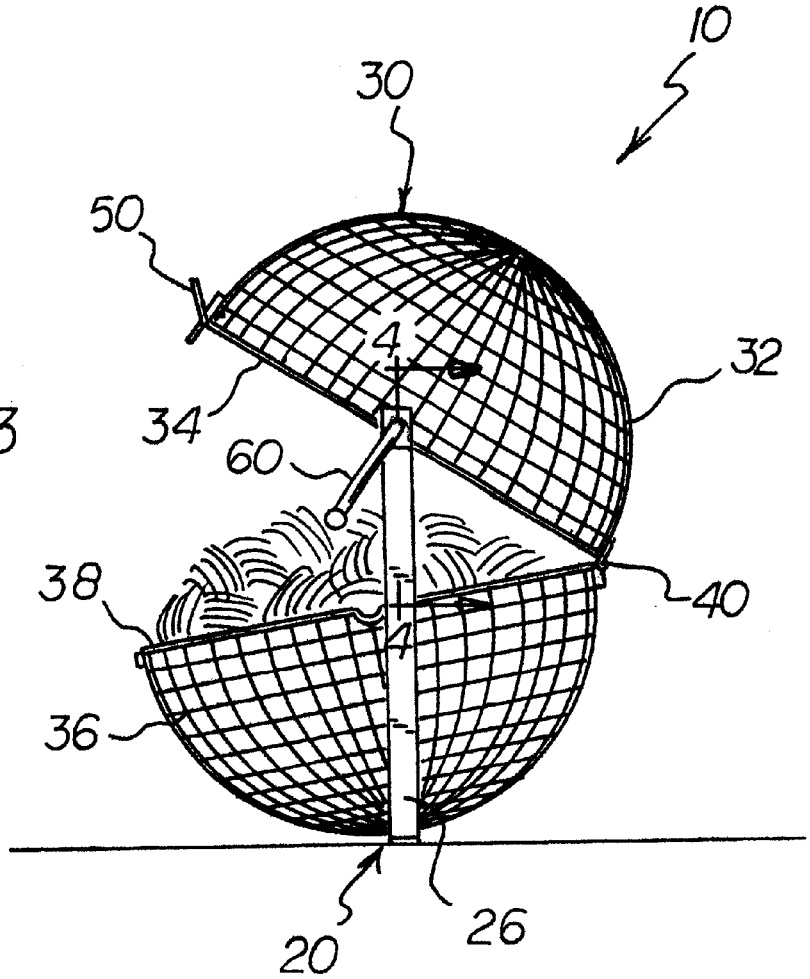
FIG. 3 is a side view of the fiber tumbler in an open orientation taken along line 3—3 of FIG. 2.

FIG. 1 is a perspective view of a fiber tumbler 10 for cleaning fiber prior to spinning, in accordance with one embodiment. Provided is an underlying structure 12 including a substantially horizontally-oriented planar top 14 with a substantially rectangular configuration. Of course, the underlying structure 12 may take any desired form, and may be included with the present embodiment or may simply include an already existent ground surface, etc. As an option, a plurality of stanchions (not shown) may be coupled to corners of the planar top 14 and depend from the planar top 14 for support purposes. In such embodiment, the underlying structure 12 may take the form of a table or the like.

Also included is a pair of L-shaped support arms 20 each including a horizontal portion 22 coupled to the planar top 14 of the underlying structure 12 at opposite ends thereof. Note FIGS. 1 and 2. In one embodiment, the horizontal portion 22 of each support arm 20 may be coupled to the planar top 14 via a plurality of bolts, screws or the like. Of course, any desired technique of coupling may be employed that is capable of fixing the support arms 20 with respect to the planar top 14 of the underlying structure 12.

Each L-shaped support arm 20 further includes a vertical portion 24 having a top end and a bottom end. The bottom end of the vertical portion 24 is integrally coupled to the horizontal portion 22 and extends upwardly therefrom in a right angle relationship with the horizontal portion 22. As shown in FIG. 2, a diagonal brace 26 is integrally coupled between the horizontal portion 22 and the top end of the vertical portion 24 of the associated support arm 20 for strengthening purposes.

It should be noted that the L-shaped support arms 20 may each be constructed from any desired rigid material. In one embodiment, such material may include a metallic alloy or the like. Further, in the context of the present description, the support arm(s) 20 may serve as an underlying structure in and of themselves.

Next provided is a basket 30 with a substantially hollow spherical configuration. Such basket 30 includes a first half 32 with a substantially semispherical configuration. Such first half 32 is defined by a semispherical wire mesh having an annular rim 34. This rim 34 is rotatably coupled at diametrically opposed sides to the top ends of the vertical portions 24 of the support arms 20. Note FIGS. 2 and 3.

The basket 30 further includes a second half 36 with a substantially semispherical configuration defined by a similar semispherical wire mesh. Such second half 36 of the basket 30 has an annular rim 38 hingably coupled to the annular rim 34 of the first half 32 of the basket 30. This may be accomplished with a hinge 40 having an axis parallel with that associated with the rotatable coupling between the first half 32 of the basket 30 and the top ends of the vertical portions 24 of the support arms 20. As is apparent from FIG. 3, such hinged coupling is positioned at a point substantially ninety degrees from points where the annular rim 34 of the first half 32 of the basket 30 is rotatably coupled to the top ends of the vertical portions 24 of the support arms 20.

In one embodiment, the basket 30 may be constructed from a metallic alloy. Of course, the basket 30 may be constructed utilizing any desired rigid material. In use, the first half 32 of the basket 30 and the second half 36 of the basket 30 are positionable between an open orientation for inserting and removing fiber therefrom (see FIG. 3) and a closed orientation for securing fiber therein (see FIG. 2).

The basket 30 further includes a fastener 50 coupled to the annular rim 34 of the first half 32 at a point diametrically opposed to the hinged coupling 40 between the first half 32 and the second half 36 of the basket 30. The fastener 50 serves to secure the first half 32 of the basket 30 and the second half 36 of the basket 30 in the closed orientation. The fastener 50 may include a clip, button, clamp, lock, or any other type of fastener 50 capable of selectively maintaining the basket 30 in the closed orientation. In an embodiment where the hinged coupling 40 is absent, a pair of fasteners 50 may be employed to couple the first half 32 and the second half 36 of the basket 30.

The present basket 30 is specifically tailored for containing fiber. To accomplish this, the wire mesh defines openings each with an area less than 2 square inches for preventing the fiber from falling out of the basket 30. In a preferred embodiment, the wire mesh defines openings each with an area less than 1 square inch for more effectively preventing the fiber from falling out of the basket 30.

Figure 9:
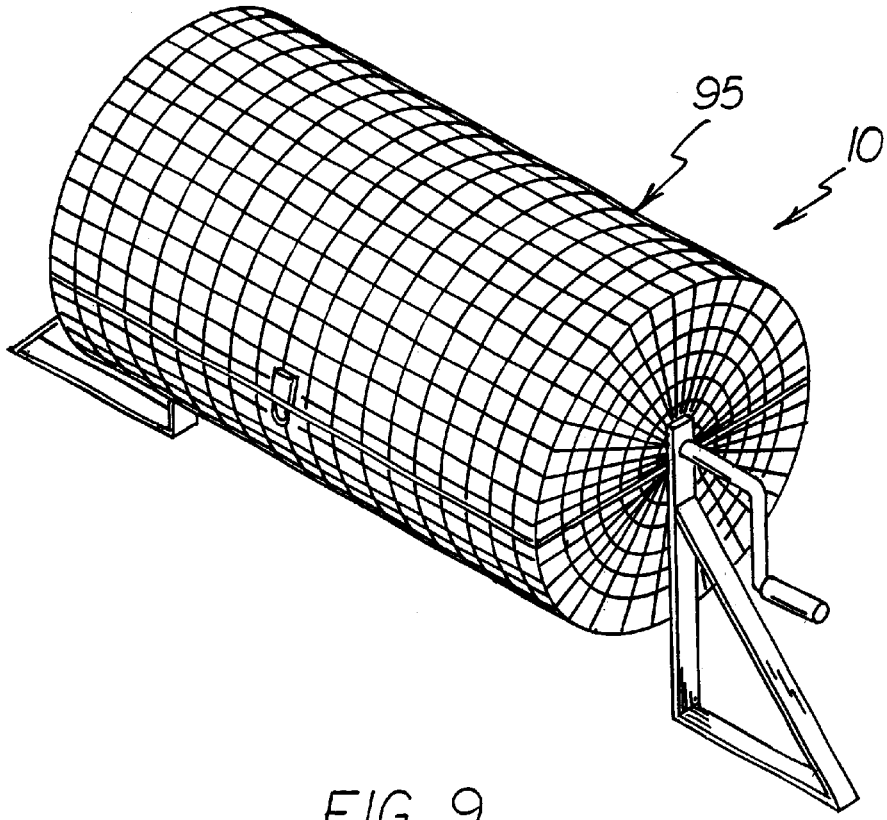
FIG. 9 is a perspective view of another alternate embodiment of the fiber tumbler, where the basket has a substantially cylindrical configuration.

It should be noted that the basket 30 may take any desired form capable of containing fiber therein, while allowing the removal of particles therefrom. FIG. 6 is a perspective view of an alternate embodiment 55 of the fiber tumbler 10. As shown, the basket 30 of the present embodiment has a substantially hollow rectangular configuration. FIG. 9 is a perspective view of another alternate embodiment 95 of the fiber tumbler 10, where the basket 30 has a substantially cylindrical configuration. Of course, the basket 30 may take any form per the desires of the user.

Also provided is a crank 60 including a first end 62 and a second end 64. The second end 64 of the crank 60 may be equipped with a grip adapted for allowing a user to rotate the basket 30 when in the closed orientation to facilitate the removal of particles from the fiber. As shown in FIG. 2, the first end 62 is parallel with the second end 64 of the crank 60.

Figure 4:
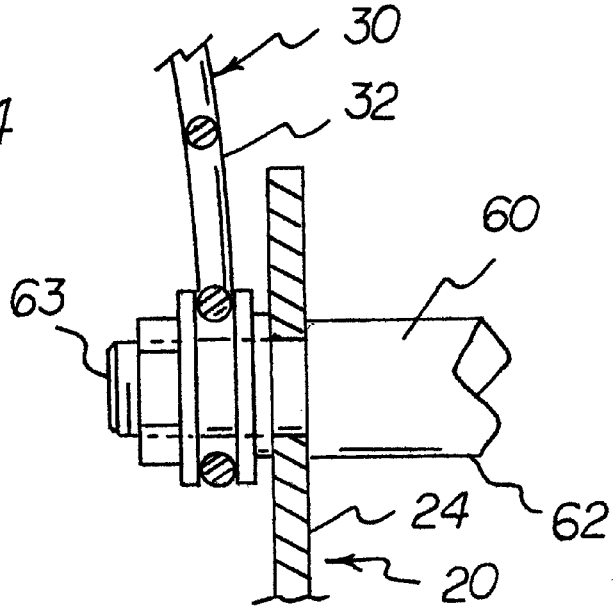
FIG. 4 is a cross-sectional view of the crank and associated components of the fiber tumbler taken along line 4—4 of FIG. 3.

In one embodiment, the first end 62 of the crank 60 includes an axle 63. As shown in FIG. 4, the axle 63 may include an annular recess for being rotatably coupled to a hole in the top end of the vertical portion 24 of the associated support arm 20. Further, the axle 63 may include a threaded portion for receiving a bolt thereon to secure the first half 32 of the basket 30 thereto. It should be noted that any type of arrangement may be utilized in lieu of the one shown in FIG. 4 for the purpose of fixedly coupling the crank 60 with respect to the basket 30, and rotatably coupling the basket 30 with respect to the support arms 20.

As shown in FIG. 5, a blower 70 is provided including a motor 72 for producing a pressurized flow of air. A flexible hose 74 is coupled to the motor 72 for allowing the user to direct the flow of air at the basket 30 to further facilitate the removal of particles from the fiber. In an unillustrated embodiment, the blower 70 may be attached to the underlying structure 12 or the support arms 20 for being directed at the basket 30.

Figure 8:
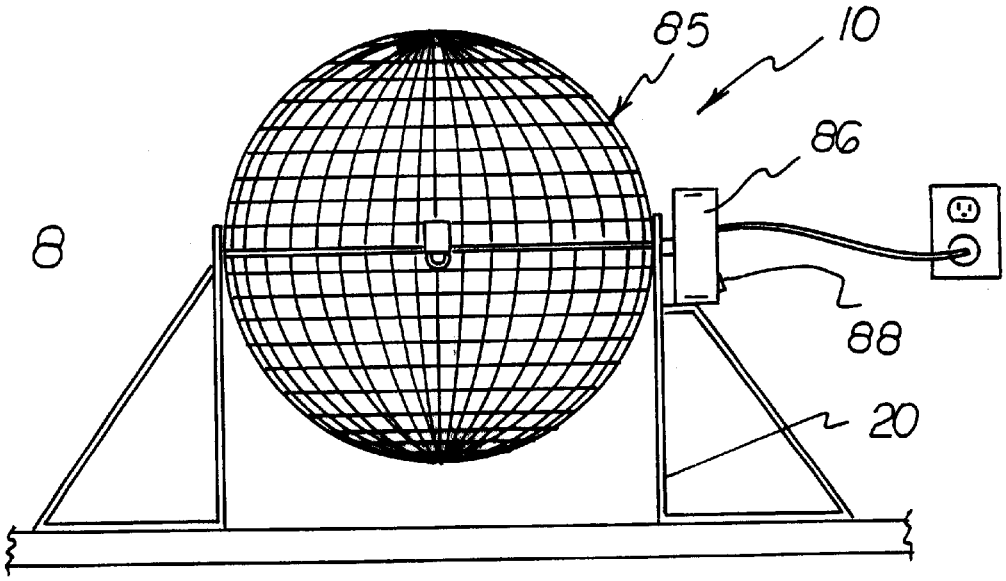
FIG. 8 is a perspective view of another alternate embodiment of the fiber tumbler including a motor for rotating the same.

In various embodiments, the crank 60 may be included instead of the blower 70, the blower 70 may be included instead of the crank 60, the crank 60 and blower 70 may be included together, and/or any other type of particle extractor may be used in conjunction with the basket 30 for removing the particles from the fiber. For example, FIG. 8 shows another alternate embodiment 85 of the fiber tumbler 10 including a motor 86 for rotating the same. As shown in FIG. 8, the motor 86 is fixedly coupled to one of the support arms 20 for rotating the basket 30 upon closing a switch 88 which selectively provides power to the motor 86.

Figure 7:
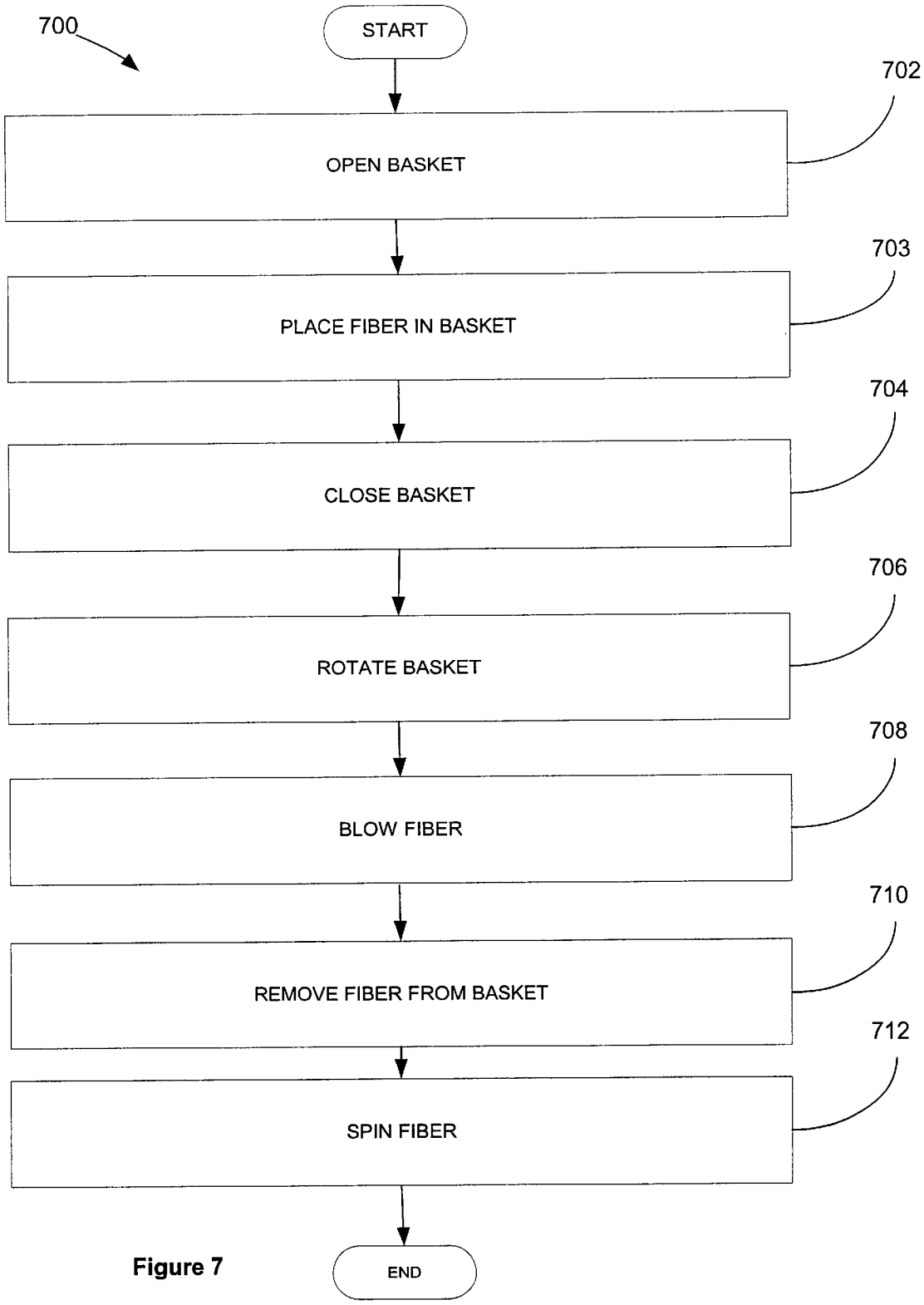
FIG. 7 is a method of cleaning fiber prior to spinning using the fiber tumbler of the foregoing figures.

FIG. 7 is a method 700 of cleaning fiber prior to spinning using the fiber tumbler 10 of the foregoing figures. As shown, in operation 702, the basket 30 is first opened in the open orientation. Thereafter, in operation 703, fiber is inserted into the open basket 30. The origin of the fiber may include an animal, organic material, synthetic material, and/or any other source per the desire of the user. For example, the fiber may include silk, dog hair, alpaca hair, polyester, and/or any other material. Of course, the fiber may take any form that is capable of being spinned.

Next, in operation 704, the basket 30 is closed in the closed orientation. The basket 30 is subsequently rotated about a horizontal axis in operation 706 utilizing the crank 60. In the context of the present description, particles may include dirt, straw, and/or any other material to be removed from the fiber before spinning. To further remove particles from the fiber, the blower 70 may be used to blow the fiber in operation 708. As an option, the blower 70 may be directed at an upper or lower apex of the basket 30. By doing so, the basket 30 is adapted to spin as a result of the airflow.

Once the particles are sufficiently removed, the fiber is removed from the basket 30 in operation 710. The fiber is then suitable for spinning. Note operation 712. By removing the particles therefrom, the fiber produces end user products of higher quality and worth.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A system for cleaning fiber, comprising:

fiber for being spun;

a structure; and a basket pivotally coupled to the structure, the basket for receiving the fiber therein;

wherein particles are removed from the fiber upon movement of the basket;

wherein the basket includes a pair of portions being selectively positionable in an open orientation for inserting and removing the fiber therefrom and a closed orientation for securing the fiber therein.

2. The system as recited in claim 1, wherein the basket includes an opening for receiving the fiber therein.

3. The system as recited in claim 1, wherein the basket has a substantially spherical configuration.

4. The system as recited in claim 1, wherein the basket has a substantially rectangular configuration.

5. The system as recited in claim 1, wherein the basket includes a fastener for securing the portions in the closed orientation.

6. The system as recited in claim 1, and further comprising a crank coupled to the basket to facilitate the movement of the basket.

7. The system as recited in claim 1, and further comprising a blower to facilitate the removal of the particles by blowing air thereon.

8. The system as recited in claim 1, wherein the basket includes a wire mesh.

9. The system as recited in claim 8, wherein the wire mesh defines openings each with an area less than 1 square inch.

10. A method of cleaning fiber, comprising:

providing fiber for being spun;

inserting the fiber into a basket which is pivotally coupled to a structure; and rotating the basket;

wherein particles are removed from the fiber upon rotation of the basket.

11. The method as recited in claim 10, wherein the basket includes an opening for receiving the fiber therein.

12. The method as recited in claim 10, wherein the basket has a substantially spherical configuration.

13. The method as recited in claim 10, wherein the basket has a substantially rectangular configuration.

14. The method as recited in claim 10, wherein a crank is coupled to the basket to facilitate the rotation of the basket.

15. The method as recited in claim 10, wherein a blower is used to facilitate the removal of the particles by blowing air thereon.

16. The method as recited in claim 10, wherein the basket includes a wire mesh.

17. A method of cleaning fiber, comprising:

providing fiber for being spun;

inserting the fiber into a basket which is pivotally coupled to a structure; and rotating the basket;

wherein particles are removed from the fiber upon rotation of the basket;

wherein the basket includes a pair of portions being selectively positionable in an open orientation for inserting and removing the fiber therefrom and a closed orientation for securing the fiber therein.

18. The method as recited in claim 17, wherein the basket includes a fastener for securing the portions in the closed orientation.

19. A method of cleaning fiber, comprising:

providing fiber for being spun;

inserting the fiber into a basket; and blowing the fiber in the basket using air;

wherein particles are removed from the fiber.

* * * * *